United States Patent [19]

Zabrowski et al.

[11] Patent Number: 5,046,373

[45] Date of Patent: Sep. 10, 1991

[54] STARTER MOTOR CONSTRUCTION

[75] Inventors: Geoffrey P. Zabrowski, Racine; Robert L. Blohm, Milwaukke, both of Wis.

[73] Assignee: Briggs & Stratton Corp., Wauwatosa, Wis.

[21] Appl. No.: 390,974

[22] Filed: Aug. 7, 1989

[51] Int. Cl.[5] ..... F02N 15/06

[52] U.S. Cl. ..... 74/7 R; 464/92

[58] Field of Search ..... 74/6, 7 R, 9; 464/92

[56] References Cited

U.S. PATENT DOCUMENTS

| | | | |
|---|---|---|---|
| Re. 20,686 | 4/1938 | Fitzgerald | 74/7 R |
| 2,299,201 | 10/1942 | Baldwin | 74/7 R |
| 2,304,476 | 12/1942 | Poplawski | 259/108 |
| 2,530,455 | 11/1950 | Forss | 259/108 |
| 2,569,267 | 9/1951 | Tobiaa | 74/7 R |
| 2,733,052 | 1/1956 | Luther | 259/122 |
| 2,850,906 | 9/1958 | Mendenhall | 74/7 R |
| 2,880,619 | 4/1959 | Digby | 74/7 R |
| 2,907,216 | 10/1959 | Smith | 74/7 R |
| 2,915,904 | 12/1959 | Digby | 74/7 R |
| 2,962,902 | 12/1960 | Buxton | 74/7 R |
| 2,984,115 | 5/1961 | Digby | 74/7 R |
| 3,024,780 | 3/1962 | Hamman | 74/7 X |
| 3,071,013 | 1/1963 | Antonidis et al. | 74/7 R |
| 3,526,146 | 9/1970 | Harkness | 74/7 R |
| 3,625,071 | 4/1970 | Harkness | 74/7 R |
| 3,666,958 | 5/1972 | Ruhle et al. | 290/48 |
| 3,788,150 | 1/1974 | Matsumoto | 74/7 R |
| 4,255,982 | 3/1981 | Kern | 74/7 R |
| 4,330,713 | 5/1982 | Greenwood | 290/48 |
| 4,369,666 | 1/1983 | Kern | 74/7 R |
| 4,479,394 | 10/1984 | Greenwood | 74/7 R |

FOREIGN PATENT DOCUMENTS

| | | | |
|---|---|---|---|
| 839572 | 4/1939 | France | 74/7 R |

*Primary Examiner*—Allan D. Hermann

*Attorney, Agent, or Firm*—Andrus, Sceales, Starke & Sawall

[57] ABSTRACT

A starter motor construction including a drive shaft and a spline having an external helical thread is disposed concentrically of the shaft and rotates therewith. An internally threaded pinion is engaged with the spline and moves axially outward on rotation of the drive shaft against the force of a biasing spring to effect engagement of the pinion with a ring gear on the flywheel of the engine. A cushioning mechanism is incorporated between the drive shaft and the spline and includes a pair of metal plates, one of which is secured to the drive shaft and the other to the spline. A resilient disc composed of a rubber-like material is bonded to the opposed faces of the plates and is provided with a continuous peripheral groove. The cushioning mechanism acts to absorb radial torque and axial force as the pinion is moved into engagement with the ring gear.

10 Claims, 2 Drawing Sheets

FIG. 3
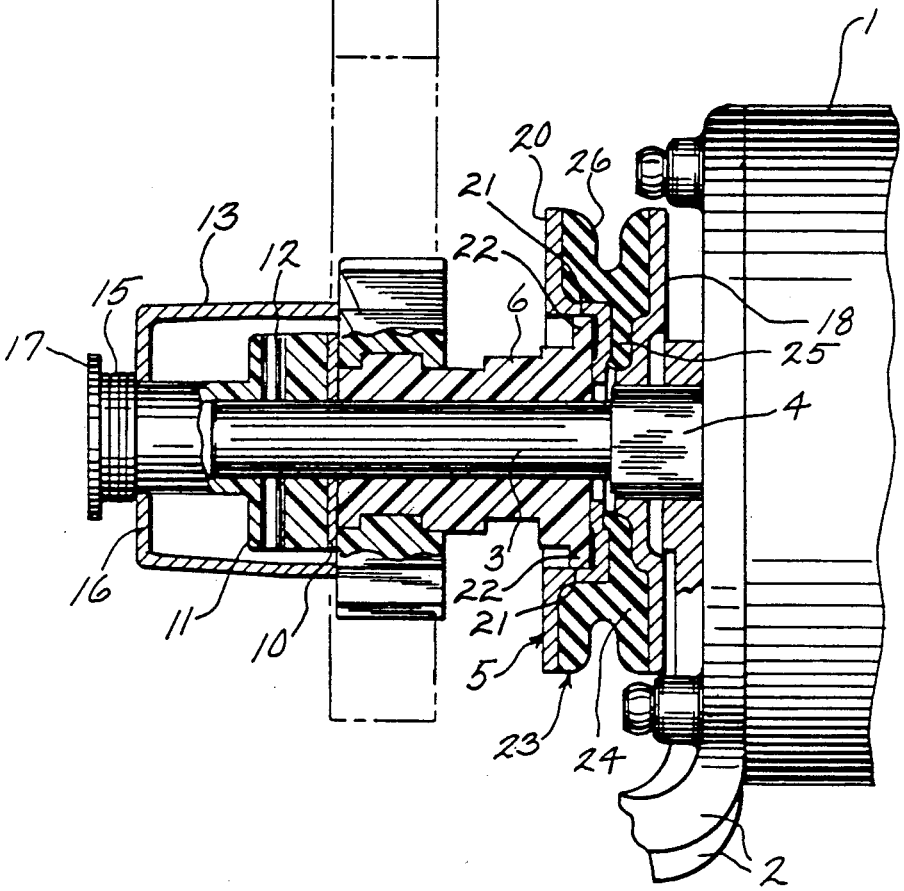
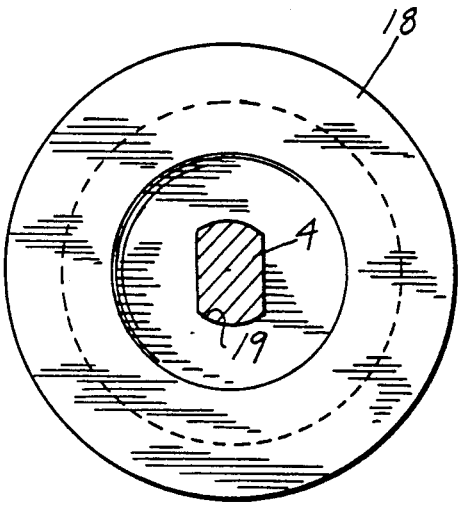
FIG. 4
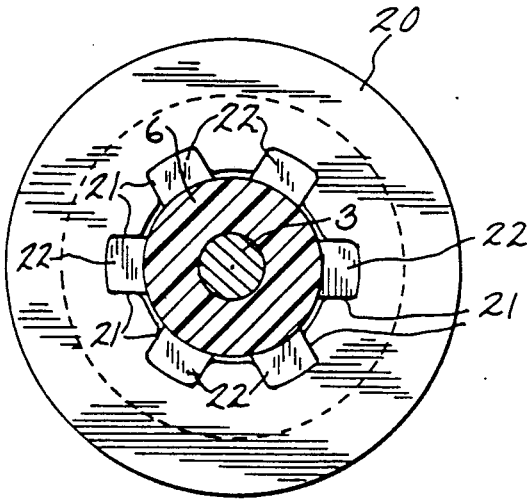
FIG. 5

STARTER MOTOR CONSTRUCTION

BACKGROUND OF THE INVENTION

A typical starter motor for an internal combustion engine includes a pinion which is mounted rotation with the motor drive shaft and is also mounted to move axially on the shaft. On operation of the starter motor, the pinion will be moved axially along the drive shaft into engagement with the ring gear on the flywheel of the engine. When the engine starts, the flywheel rotates the pinion at an increased speed, overriding the speed of the starter shaft and moving the pinion back to its original axial starting position, out of engagement with the ring gear teeth.

The meshing of the teeth of the pinion with the teeth of the ring gear occurs by lateral insertion of the pinion teeth into the ring gear teeth. As the pinion teeth enter the teeth of the ring gear, both radial torque and axial impact force are imparted to the teeth of the pinion.

Because of this, the conventional starter motor includes a cushioning mechanism which will absorb the shock caused by engagement of the pinion teeth with the teeth of the ring gear and permit the teeth to align without damage to the starter or engine structure. In the typical starter motor construction, the pinion is formed of a metal that is harder and more wear resistant than the metal of the gear ring on the flywheel and the cushioning mechanisms, as used in the past, have been designed to prevent chipping or other damage to the teeth of the flywheel gear ring.

SUMMARY OF THE INVENTION

The invention is directed to an improved cushioning mechanism for a starter motor and particularly to a starter motor utilizing a pinion composed of fiber reinforced resin. In accordance with the invention, an externally threaded spline is mounted concentrically of the starter motor drive shaft and a pinion, having an internal thread, is engaged with the spline and on rotation of the drive shaft, is adapted to move axially outward on the drive shaft against the force of a biasing spring to effect engagement of the pinion teeth with the teeth of a gear ring mounted on the flywheel of the engine.

The cushioning mechanism is incorporated between the drive shaft and the spline and includes a pair of spaced, parallel metal plates, one of which is secured to the drive shaft, while the other plate is secured to the spline. A resilient, rubber-like disc, is bonded to the opposed surfaces of the plates and the disc has a continuous peripheral groove.

On operation of the starter motor, the pinion will be moved outwardly by inertial force along the spline to bring the teeth of the pinion into engagement with the teeth of the ring gear, and the resilient disc will absorb the axial shock of the pinion tooth engagement with the ring gear. In addition, circumferential deformation of the disc will cushion the radial torque as the pinion drives the ring gear on engine cranking. The peripheral groove in the resilient disc provides the necessary resiliency to absorb both the radial torque and the axial impact.

The invention provides an improved cushioning mechanism for a starter motor having particular application for use with a motor incorporating a pinion composed of fiber reinforced resin. The cushioning mechanism absorbs axial impact on contact of the pinion with the ring gear to prevent chipping of the pinion teeth and also provides a relatively soft cushioning during pinion engagement with the ring gear and a firmer cushioning during cranking.

Other objects and advantages will appear in the course of the following description.

DESCRIPTION OF THE DRAWINGS

The drawings illustrate the best mode presently contemplated of carrying out the invention.

In the drawings:

FIG. 3 is a view similar to FIG. 2 stowing the pinion in engagement with the ring gear on the flywheel;

FIG. 4 is a section taken along line 4—4 of FIG. 2; and

FIG. 5 is a section taken along line 5—5 of FIG. 2.

DESCRIPTION OF THE ILLUSTRATED EMBODIMENT

Figure 1:
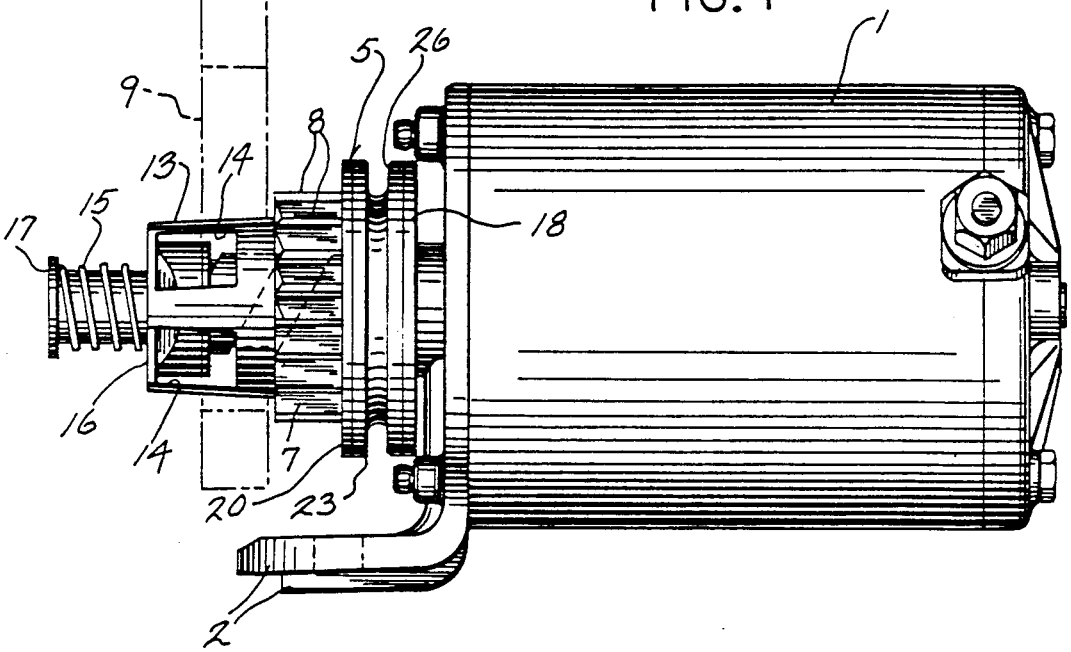
FIG. 1 is a side elevation of the starter motor of the invention.

The drawings illustrate a starter motor construction for use with an internal combustion engine and the construction includes a motor 1, which is mounted through bracket 2 to the engine, not shown. Motor 1 includes a drive shaft 3 having a generally rectangular section 4 located adjacent motor 1, and a cushioning mechanism 5 interconnects the rectangular section 4 of shaft 3 with a spline 6 that is disposed concentrically around shaft 3.

The outer surface of spline 6 is provided with a helical thread, which is engaged with the internal thread of a pinion 7. Pinion 7 is provided with a plurality of external teeth 8, which are adapted to engage the teeth on a ring gear 9 that is attached to the flywheel of the engine.

Both the spline 6 and pinion 7 can be formed of a non-metallic material, such as plastic, and preferably the plastic material is reinforced by chopped fibrous material, which may take the form of mineral fibers, such as glass, synthetic fibers, or metal fibers.

A washer 10 is interposed between the outer end of spline 6 and a retainer 11, which is connected to the outer end portion of shaft 3 via a pin 12, that extends through aligned openings in the retainer and the shaft.

Figure 2:
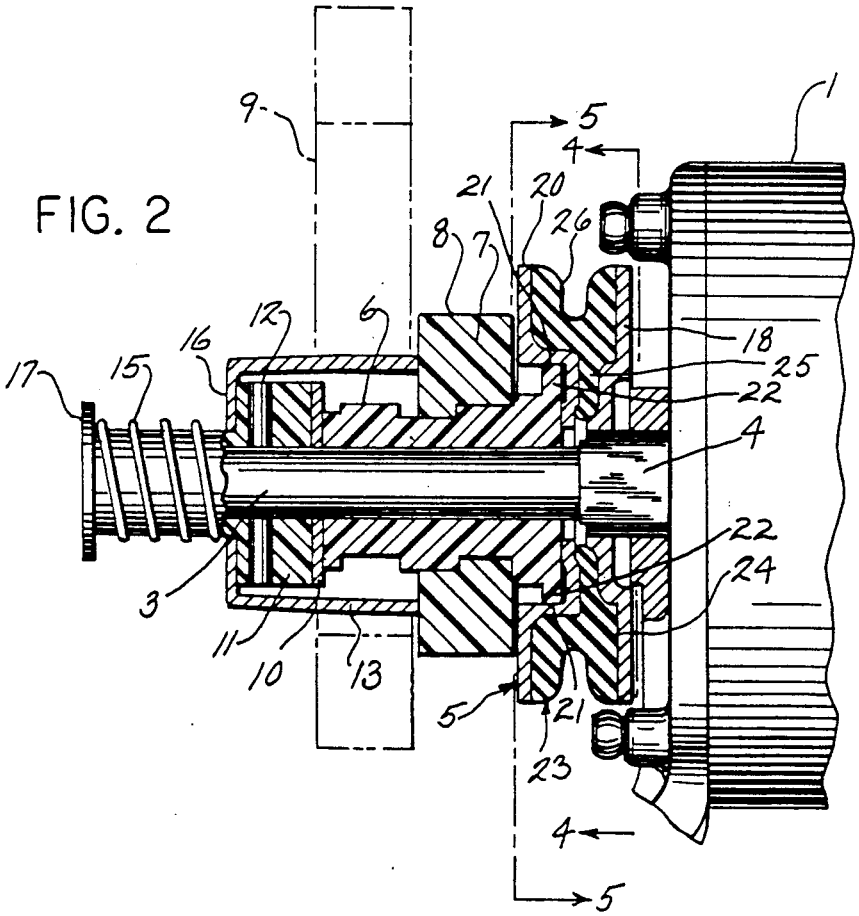
FIG. 2 is an enlarged fragmentary longitudinal section of the starter motor with the pinion being shown in the disengaged or rest position.

Pinion 7 is biased inwardly toward motor 1 and the biasing mechanism includes a cup-shaped cap or cage 13 that is mounted around the outer end of retainer 11. The inner end of cap 13 bears against the outer surface of pinion 7 and the cap is provided with a plurality of openings 14. As shown in FIG. 2, a coil spring 15 is positioned between the base or outer surface 16 of cap 13 and a disc 17 which is located on the end of retainer 11. The force of spring 15 will urge the pinion 7 inwardly toward the motor 1.

The cushioning mechanism 5 of the invention includes an inner plate 18, preferably formed cf a metal stamping and having a generally rectangular central opening 19 which receives the rectangular section 4 of shaft 3, as illustrated in FIG. 4. In addition the cushioning mechanism includes a second plate 20 which is located outwardly of plate 18 and plate 20 is provided with a plurality of circumferentially spaced recesses or pockets 21 which receive radially extending projections 22 on spline 6, as seen in FIG. 5. Thus, rotation of plate 20 will be transmitted to spline 6, through the engagement of projections 22 with recesses 21.

Bonded to the opposed faces of plates 18 and 20 is a rubber-like disc 23 having a Durometer in the range of 20 to 90. As shown in FIGS. 2 and 3, the outer portion 24 of disc 23 has a greater axial width than the inner portion 25 and the outer portion 24 is provided with a circumferential groove 26 which extends around the entire periphery of disc 23. As seen in FIGS. 2 and 3, the outer edges of groove 26 are generally rounded or radiused, and similarly, the bottom of the groove 26 is curved or rounded. The rounded configuration at the bottom of the groove will tend to resist rupture of the disc 23 when the disc is subjected to torsional deformation.

In operation, rotation of drive shaft 3 is transmitted through the cushioning mechanism 5 to spline 6. Rotation of spline 6 will move the pinion axially by inertial force to effect engagement of the pinion teeth 8 with the teeth of ring gear 9. The engagement of the pinion teeth with the gear ring teeth imposes impact or axial shock on the pinion and the shock is absorbed by axial compression of the resilient disc 23.

When the pinion teeth 8 are engaged with the gear ring teeth to drive the gear ring, the torque is absorbed by circumferential deformation of the resilient disc 23. The configuration of the disc, including the circumferential groove 26, provides a relatively soft cushioning during alignment of the pinion teeth with the gear ring teeth and provides a firmer cushioning during cranking of the engine.

Once the engine has started, the flywheel rotates the pinion gear at a rate faster than during cranking, thus overriding the speed of the drive shaft 3 and moving the pinion 7 back to its original axial starting position, out of engagement with the ring gear teeth.

Various modes of carrying out the invention are contemplated as being within the scope of the following claims particularly pointing out and distinctly claiming the subject matter which is regarded as the invention.

We claim:

1. A starter motor construction for an internal combustion engine, comprising a motor having a drive shaft, a first gear disposed concentrically outward of said drive shaft, means responsive to rotation of said drive shaft for moving said first gear axially of said drive shaft to engage said first gear with a second gear of said engine, and cushioning means interconnecting said drive shaft and said first gear and including a first annular member disposed concentrically of said drive shaft and secured to said drive shaft, a second annular member disposed concentrically of said drive shaft and operably connected to said first gear, and a resilient annular disc disposed between said first and second annular members and secured to opposed faces of said members, said disc having a circumferential groove spaced axially from said members, said groove being bordered by a pair of generally parallel side surfaces and a bottom surface, the junction between said side surfaces and said bottom surface being generally curved, axial deformation of said disc acting to absorb axial shock and circumferential deformation of said disc acting to absorb torque generated by engagement of said first gear and said second gear.

2. A starter motor construction for an internal combustion engine, comprising a motor having a drive shaft, a first gear disposed concentrically outward of said drive shaft, means responsive to rotation of said drive shaft for moving said first gear axially of said drive shaft to engage said first gear with a second gear of said engine, and cushioning means interconnecting said drive shaft and said first gear and including a first annular member disposed concentrically of said drive shaft and secured to said drive shaft, a second annular member disposed concentrically of said drive shaft and operably connected to said first gear, and a resilient annular disc disposed between said first and second annular members and secured to opposed faces of said members, said disc having a circumferential groove spaced axially from said members, said disc having an inner radial section and an outer radial section, said outer radial section having a greater axial dimension than said inner section and said groove being disposed in said outer section, axial deformation of said disc acting to absorb axial shock and circumferential deformation of said disc acting to absorb torque generated by engagement of said first gear and said second gear.

3. A starter motor construction for an internal combustion engine, comprising a motor having a drive shaft, a first gear disposed concentrically outward of said drive shaft, means responsive to rotation of said drive shaft for moving said first gear axially of said drive shaft to engage said first gear with a second gear of said engine, and cushioning means interconnecting said drive shaft and said first gear and including a first annular member disposed concentrically of said drive shaft and secured to said drive shaft, a second annular member disposed concentrically of said drive shaft and operably connected to said first gear, and a resilient annular disc disposed between said first and second annular members and secured to opposed surfaces of said members, said disc having a circumferential groove spaced axially from said members, said groove having a greater radial depth than axial width, axial deformation of said disc acting to absorb axial shock and circumferential deformation of said disc acting to absorb torque generated by engagement of said first gear and said second gear.

4. The construction of claim 3, wherein said first and second annular members comprise metal plates, the outer diameter of said metal plates being substantially equal to the outer diameter of said disc.

5. A starter motor construction, comprising a motor having a drive shaft, a spline disposed concentrically around said shaft and having an external thread, a pinion gear having an internal thread engaged with the external thread of said spline, said pinion gear having a plurality of external teeth, connecting means interconnecting said drive shaft and said spline for transmitting rotation of said drive shaft to said spline, said pinion being movable axially of said spline on rotation of said shaft to move said spline into engagement with a second gear of an engine, said connecting means including a first annular member disposed concentrically of said drive shaft and secured to said drive shaft, a second annular member secured to said spline and disposed concentrically of said drive shaft, and a resilient annular disc disposed between said first and second members and secured to opposed faces of said members, said resilient disc having a peripheral groove extending around the entire periphery of said disc, axial deformation of said disc acting to absorb axial shock caused by engagement of said pinion gear with said second gear and circumferential deformation of said disc absorbing radial torque.

6. The construction of claim 5, wherein said groove has a greater radial depth than axial width.

7. The construction of claim 5, wherein said second member is provided with a plurality of circumferentially spaced recesses and said spline is provided with a plurality of radially spaced projections engaged with said recesses to provide a driving connection between said second member and said spline.

8. The construction of claim 5, and including biasing means for urging said pinion gear axially of said spline in a direction toward said motor.

9. The construction of claim 6, wherein said pinion gear is composed of plastic and contains chopped fibrous reinforcing material.

10. The construction of claim 5, wherein said groove is bordered by a pair of generally parallel radially extending side walls and the bottom of said groove is bordered by a bottom wall, the junction between said side walls and said bottom wall being rounded.

* * * * *